US010670377B2

(12) United States Patent
Tessel et al.

(10) Patent No.: US 10,670,377 B2
(45) Date of Patent: Jun. 2, 2020

(54) HIT-SCORING APPARATUS AND TARGET PANEL FOR SHOOTING PRACTICE

(71) Applicants: Mordechai Tessel, Kfar Saba (IL); Natanel Tessel, Kfar Saba (IL)

(72) Inventors: Mordechai Tessel, Kfar Saba (IL); Natanel Tessel, Kfar Saba (IL)

( * ) Notice: Subject to any disclaimer, the term of this patent is extended or adjusted under 35 U.S.C. 154(b) by 79 days.

(21) Appl. No.: 16/068,100

(22) PCT Filed: Jan. 11, 2017

(86) PCT No.: PCT/US2017/013026
§ 371 (c)(1),
(2) Date: Jul. 3, 2018

(87) PCT Pub. No.: WO2017/123638
PCT Pub. Date: Jul. 20, 2017

(65) Prior Publication Data

US 2019/0025017 A1 Jan. 24, 2019

(30) Foreign Application Priority Data

Jan. 13, 2016 (IL) ..... 243602

(51) Int. Cl.
*F41J 5/048* (2006.01)
*F41J 1/10* (2006.01)

(52) U.S. Cl.
CPC . *F41J 5/048* (2013.01); *F41J 1/10* (2013.01)

(58) Field of Classification Search
CPC ..... F41J 5/044; F41J 5/048
USPC ..... 273/373, 403–408
See application file for complete search history.

(56) References Cited

U.S. PATENT DOCUMENTS

| | | | | |
|---|---|---|---|---|
| 3,529,828 | A | 9/1970 | Thalmann | |
| 3,580,579 | A | 5/1971 | Scharz et al. | |
| 3,737,166 | A * | 6/1973 | Knight | F41J 1/10 273/372 |
| 4,129,299 | A | 12/1978 | Busch | |
| 4,706,963 | A * | 11/1987 | Geuss | B25B 5/003 250/495.1 |
| 4,786,058 | A * | 11/1988 | Baughman | F41J 5/04 273/371 |
| 4,828,269 | A | 5/1989 | Tessel | |
| 4,946,171 | A * | 8/1990 | Merle | F41J 1/00 250/495.1 |
| 5,193,816 | A * | 3/1993 | Ahmed | F41J 5/044 273/373 |
| 6,994,347 | B2 * | 2/2006 | Tessel | F41J 5/048 273/373 |
| 8,047,546 | B1 * | 11/2011 | Klein | F41J 7/06 273/392 |
| 2004/0036221 | A1 | 5/2004 | Martinez | |
| 2005/0212216 | A1 | 9/2005 | Tessel et al. | |
| 2009/0194943 | A1 | 8/2009 | Amitai et al. | |

* cited by examiner

*Primary Examiner* — Mark S Graham
(74) *Attorney, Agent, or Firm* — Guy Levi; The IP Law Firm of Guy Levi, LLC

(57) ABSTRACT

The present invention is directed to a hit-scoring apparatus for shooting practice. It is also directed to a hit-scoring target panel for shooting practice.

9 Claims, 7 Drawing Sheets

HIT-SCORING APPARATUS AND TARGET PANEL FOR SHOOTING PRACTICE

CROSS REFERENCE TO RELATED APPLICATIONS

This patent application is a U.S. National Phase filing of co-pending, commonly owned PCT Application No. PCT/US17/013026, filed Jan. 11, 2017, which claims priority from Israeli Patent Application No. 243602, filed Jan. 13, 2016 both which are incorporated herein by reference in their entirety.

FIELD OF THE INVENTION

The present invention relates to a hit-scoring apparatus for shooting practice. It also relates to a hit-scoring target panel for shooting practice.

BACKGROUND OF THE INVENTION

U.S. Pat. No. 6,994,347 discloses a hit-scoring apparatus for shooting practice, comprising a target holder consisting of a body constituting the fixed first jaw and a moveable second jaw of a clamping device, the first jaw and the second jaw being electrically insulated from one another, and means adapted to produce a relative movement between the first jaw and the second jaw. A target panel is clamped between the first and second jaws and consists of a plurality of layers including an electrically conductive first layer and an electrically conductive second layer separated and spaced apart from the front layer by at least one electrically non-conductive layer. When the target panel is clamped between the first and second jaws of the target holder, separate electrical contacts are established between the first layer and the first jaw on the one hand, and between the second layer and the second jaw on the other hand, the first and second jaws being further connectable to a hit-scoring unit.

In order that the second layer makes electrical contact with the electrically conductive rear jaw, the metallic surface of the second layer must initially extend below the lower edge of the target and be folded at its lower edge during manufacture and secured by adhesive to the rear surface of the target. This can only be done manually and is therefore time-consuming and expensive.

The first layer is subdivided into different areas that are electrically insulated from each other and are each connected to a different one of the electrical contacts on the first jaw. The second layer provides a unitary conductive surface that is connected to the second jaw, which must be electrically conductive. An electronic circuit is mounted inside the fixed first jaw and detects when the two layers are shorted by a bullet. To this end, the electronic circuit must also be electrically connected to the conductive second jaw, this being done by a wire. Constant movement of the second jaw may subject the wire to fatigue, causing it to be break eventually and require replacement.

The different areas of the first layer allow the electronic circuit to discriminate between distinct areas of the target and provide feedback to the marksman as to where the bullet entered the target. The value of this feedback clearly depends on the number of distinct areas that can be separately isolated in the first layer. In theory, the second layer could also be subdivided into distinctive areas in order to improve the resolution of the discrimination but in practice this would require that the second jaw support separate contacts, each of which would then need to be connected to the electronic circuit by a respective wire.

In the target panel disclosed in U.S. Pat. No. 6,994,347, a discrete conductive area of the target connected to a contact pad in the apparatus that senses the short circuit caused by the bullet defines uniquely where the bullet strikes the target. This requires that the contact areas be spatially separated: the conductive tracks that route the contact areas to the contact pads cannot be allowed to cross a different contact area. This limits the measurement resolution of such a target since any given contact area cannot easily be further sub-divided into concentric areas owing to the difficulty in routing each sub-area to a separate contact pad. Provided that were sufficient contact pads available, it would be possible to sub-divide the contact areas and connect them by wires to the contact pads. However, this is not really practical since it significantly increases the cost of assembly.

It must be borne in mind that target practice is often carried out in hostile environments and the device must be sufficiently robust to withstand manhandling. The use of wires to connect the contacts of the moveable jaw to the second conductive layer of the target militates against the provision of additional channels that would allow better discrimination.

It would clearly be preferable to allow the second layer also to be subdivided in order to increase the resolution of the electronic circuit, while doing so in a manner that obviate the needs for wire connections from the moveable jaw to the discrimination circuitry.

SUMMARY OF THE INVENTION

It is therefore an object of the invention to provide an improved hit-scoring apparatus for shooting practice that addresses these requirements.

This object is realized by a hit-scoring apparatus for shooting practice and a target panel therefor having the features of the respective independent claims.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1:
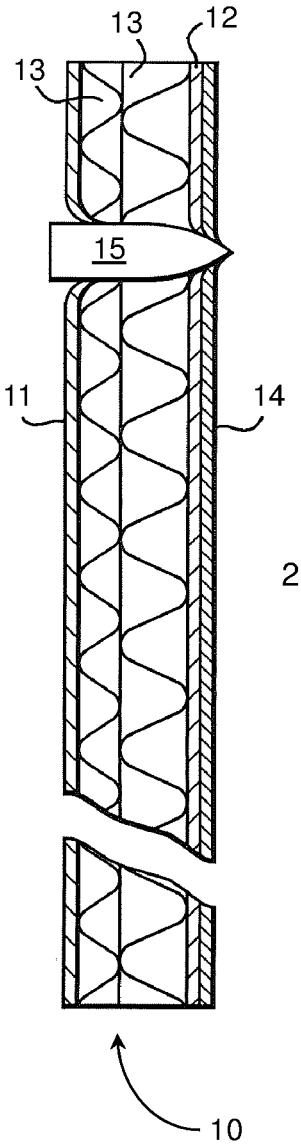
FIG. 1 is a cross-section of a target panel according to the invention.

FIG. 1 is a pictorial cross-section of a target panel 10 according to the invention having an electrically conductive first layer 11 and an electrically conductive second layer 12 separated and spaced apart from the first layer by at least one electrically non-conductive layer 13 formed of standard, double-layer, corrugated cardboard. The first layer 11 is directed forward toward the sniper and comprises a thin aluminum film, advantageously provided with an anodized or otherwise colored front surface of a dark hue which reduces reflectivity and glare without impairing conductivity. The second layer 12 is likewise a thin aluminum film, which is glued to the rear surface of the non-conductive layer 13. The outer rear surface of the panel is constituted by a layer of resin-impregnated paper 14 for reinforcement and waterproofing.

A projectile such a bullet 15 having a metal shell penetrating the target panel shorts the two conductive layers 11, 12, thereby completing an electrical circuit, which indicates a hit and also provides an indication of where the target was hit. To this end, the layers are sub-divided into distinct target areas that correspond to respective areas of anatomy of the target such as the head, upper torso, heart area etc. The target areas are electrically insulated from each other and each is connected to a respective conductive pad at a lower edge of the target panel, so that when the target panel is clamped between jaws of a hit-scoring apparatus, the conductive pad makes good electrical contact with a contact disposed on a jaw in the hit-scoring apparatus.

Figure 2:
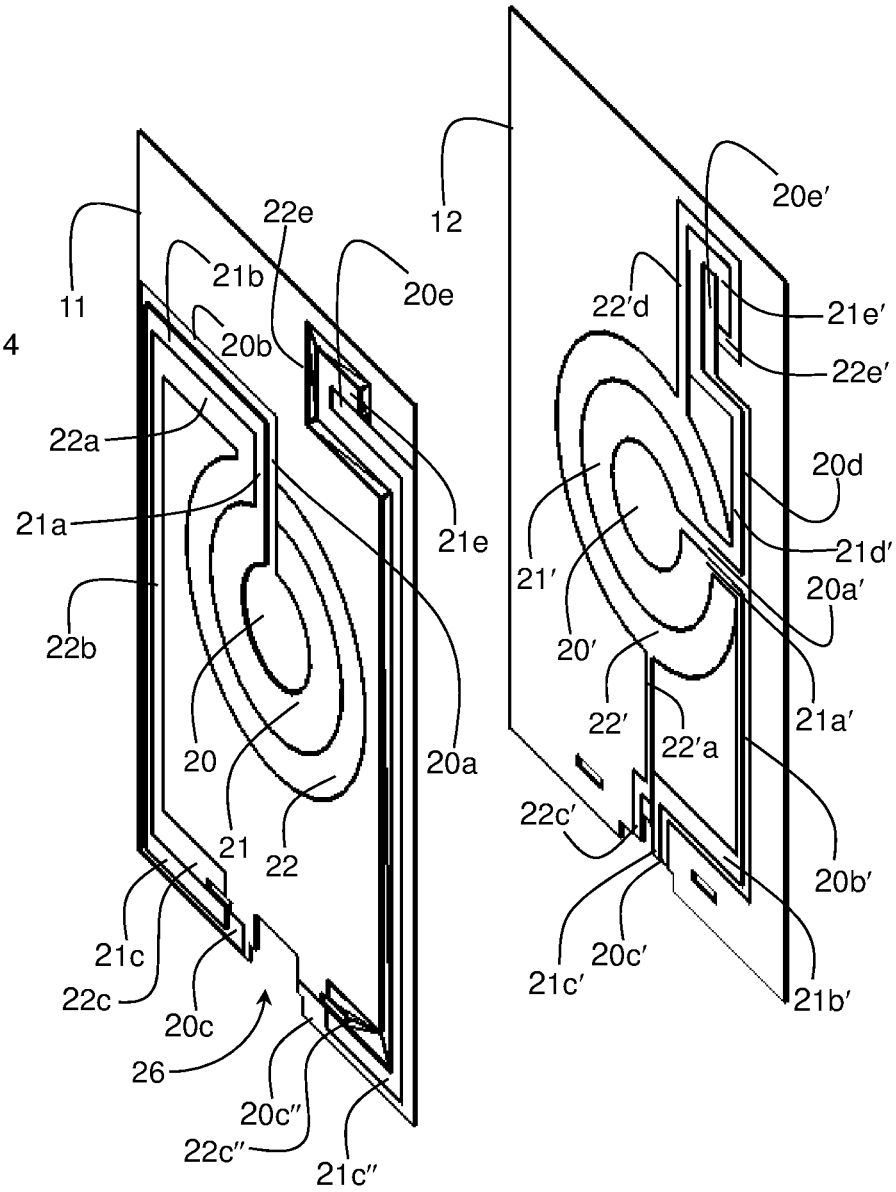
FIG. 2 is a perspective view showing a detail of electrically conductive layers in the target panel.
Figure 2A:
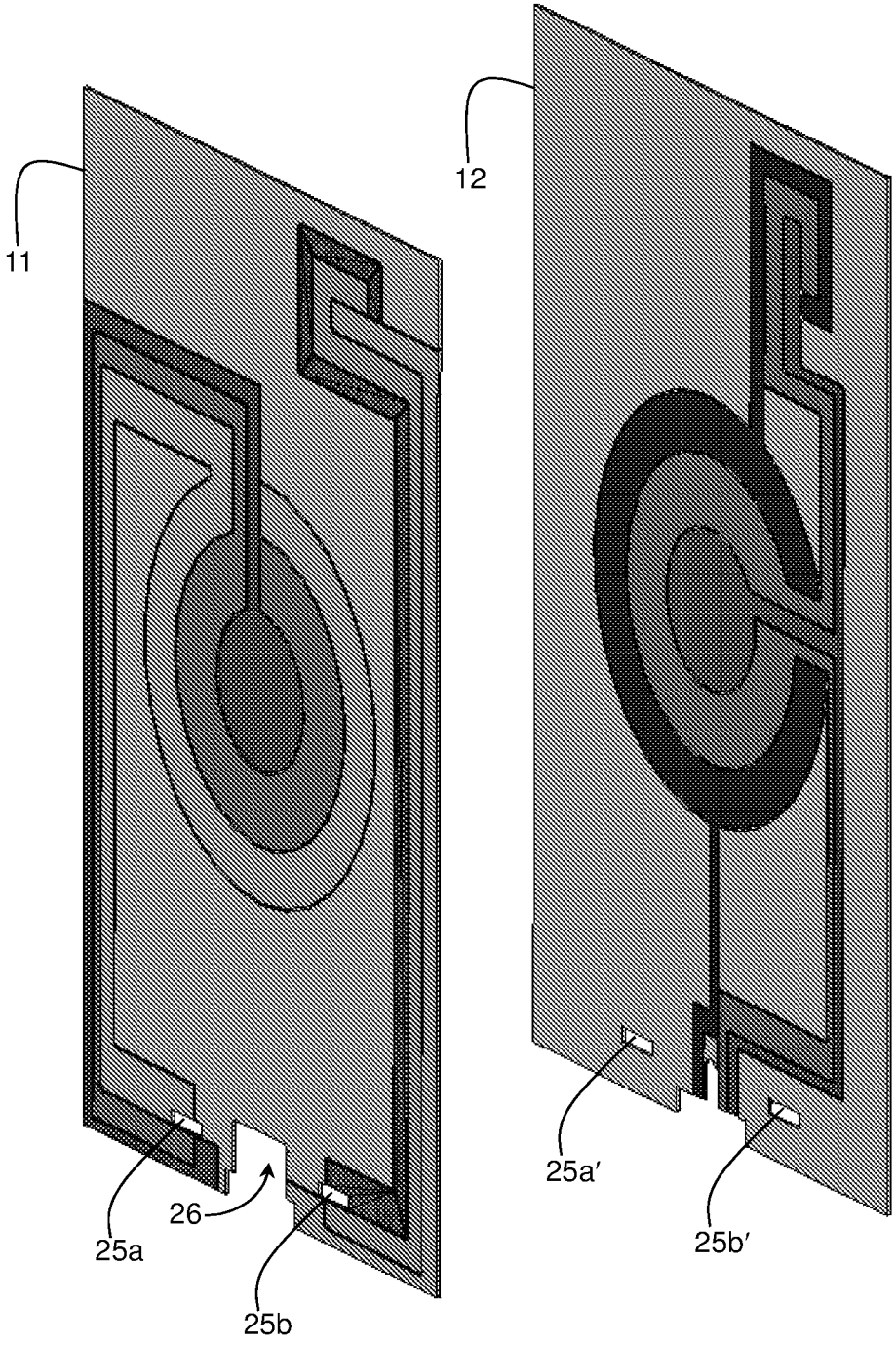
FIG. 2*a* is identical to FIG. 2 but shows the contact areas in complementary colors for greater clarity.

FIGS. 2 and 2*a* are perspective views showing a detail of the layers 11 and 12 of the target panel 10. FIG. 2*a* is the same as FIG. 2 except that the contact areas are shown using different colors for greater clarity for those jurisdictions where it is possible to file colored drawings. In jurisdictions where colored drawings are inadmissible, FIG. 2*a* will be converted to greyscale. The first layer 11 has a central circular conductive first area 20 to which there are connected conductive tracks 20*a* and 20*b* that are routed to a contact pad 20*c*. Surrounding the first area 20 is an annular conductive second area 21, which is electrically insulated from the first area 20 and to which there are connected conductive tracks 21*a* and 21*b* that are routed to a contact pad 21*c*. Likewise, surrounding the second area 21 is an annular conductive third area 22, which is electrically insulated from the second area 21 and to which there are connected conductive tracks 22*a* and 22*b* that are routed to a contact pad 22*c*. The contact pads 20*c*, 21*c* and 22*c* are located toward the lower edge of the layer 11 for abutting respective contacts of the hit scoring apparatus as described below with reference to FIGS. 5 to 8 of the drawings.

Thus far, the target panel 10 is functionally identical to that described in above-mentioned U.S. Pat. No. 6,994,347. However, unlike U.S. Pat. No. 6,994,347 where the rear target panel has only a single conductive area that is folded back in order to allow connection to the rear jaw, in the target panel 10 according to the invention the second layer 12 has multiple conductive areas denoted by 20', 21' and 22'. Thus, a central circular conductive first area 20' is routed via conductive tracks 21*a*' and 21*b*' to a contact pad 20*c*'. Surrounding the first area 20' is an annular conductive second area 21', which is electrically insulated from the first area 20' and to which there are connected conductive tracks 21*a*' and 21*b*' that are routed to a contact pad 21*c*'. Likewise, surrounding the second area 21' is an annular conductive third area 22', which is electrically insulated from the second area 21' and to which there is connected a conductive track 22*a*' that is routed to a contact pad 22*c*'. The contact pads 20*c*', 21*c*' and 22*c*' are also located toward the lower edge of the layer 12 for abutting respective contacts of the hit scoring apparatus.

Figure 3:
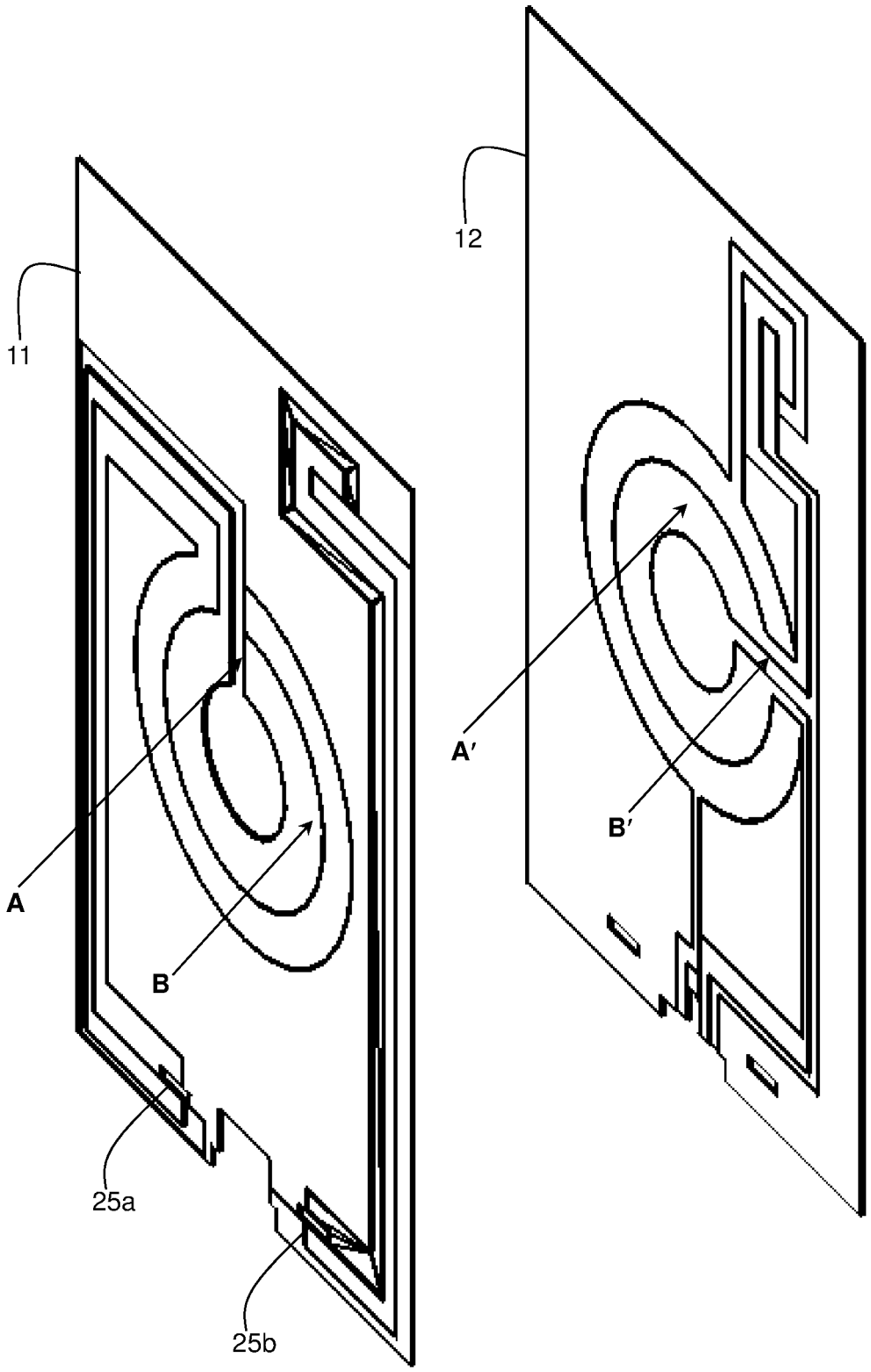
FIG. 3 is a perspective view of the two layers of the target panel showing the principle of discrimination between different bullet paths.

The first area 20' is also routed via a conductive track 20*d*' to a conductive area 20*e*' in a portion of the second layer 12 that is spatially displaced from the central portion 21'. Similarly, the second area 21' is also routed via a conductive track 21*d*' to a conductive area 21*e*' proximate and partly surrounding the area 20*e*' and the third area 22' is also routed via a conductive track 22*d*' to a conductive area 22*e*' proximate and partly surrounding the area 21*e*'. In order to allow detection of a bullet penetrating one of the areas 20*e*', 21*e*' and 22*e*' in the second layer 12, complementary conductive areas 20*e*, 21*e* and 22*e* are provided in overlapping areas of the first layer 11 and are routed to respective contact pads 20*c*", 21*c*" and 22*c*" located toward the lower edge of the layer 12 for abutting respective contacts of the hit scoring apparatus. The contact areas 20*e*, 21*e* and 22*e* on the first layer 11 together with the complementary contacts 20*e*', 21*e*' and 22*e*' of the second layer 12 define a generally rectangular portion of the target corresponding to critical anatomical features of the target, which when hit by a bullet are likely to cause significant damage to the victim. The same is true regarding the contact areas 20, 21, 22 of the first layer 11 corresponding to and overlapping the contact areas 20', 21', 22' of the second layer 12. In order to ensure during manufacture that the complementary contacts of both layers 11 and 12 are in proper mutual overlapping relationship, apertures 25*a*, 25*b* and mutually aligned apertures 25*a*', 25*b*' shown in FIG. 3 are formed in the first and second layers 11 and 12 respectively, so that when the respective apertures 25*a*, 25*a*' and 25*b*, 25*b*' are aligned, the two layers 11 and 12 are properly registered.

As will be explained with reference to FIG. 5, all the contact pads of both layers 11 and 12 make abutting contact with complementary contacts of the hit scoring apparatus, of all of which are mounted on the same fixed jaw thereof. To this end, one or more apertures or gaps 26 are formed in the lower edge of the first layer 11 in overlapping relationship with the contact pads 20*c*', 21*c*' and 22*c*' on the second layer 12. By such means the contact pads 20*c*', 21*c*' and 22*c*' are generally aligned with the contact pads 20*c*, 21*c*, 22*c*, 20*c*", 21*c*" and 22*c*" on the first layer 11 and all face in the same in the same direction. In the embodiment shown in FIG. 2, the contact pads 20*c*', 21*c*' and 22*c*' on the second layer 12 are clustered together, thereby allowing accessibility to the contacts of the hit scoring apparatus through the single aperture 26 in the first layer 11. However, this is not a requirement and if desired the contact pads on the two layers may be staggered thereby requiring that multiple apertures or gaps be formed in the first layer to provide accessibility to the contact pads of the second layer.

It is clear that a bullet entering the center of the first area 20 of the first layer 11 and exiting the first area 20' of the second layer will short the contact pads 20*c* and 20' thereby providing a direct indication of where the target was hit. However, owing to the mutually overlapping tracks of the first and second layers that are used to route the annular contact areas 21, 22 and 21', 22' this is no longer always the case when a bullet enters any but the centermost contact areas 20 and 20'. Thus, with reference to FIG. 3, consider a bullet that enters the first layer 11 of the target panel at arrow A and exits the second layer 12 at arrow A'. It is clear that the bullet strikes in the region of the first annular area 21, but it penetrates the conductive track 20*a* in the first layer 11 that routes the central target area 20 to the contact pad 20*c*. In the arrangement of U.S. Pat. No. 6,994,347 where the second layer 12 is a unitary conductive film, only the contact pads in the front layer allow for discrimination of where the bullet strikes the target. Thus, if the target panel 10 were employed in such an arrangement, a bullet intersecting a first contact area through the conductive track that routes a second, different contact area to the contact pad would be registered as having hit the second contact area. In other words, the contact area connected to the contact pad that senses the short circuit caused by the bullet defines uniquely where the bullet strikes the target. This requires that the contact areas on the first layer of the target panel in U.S. Pat. No. 6,994,347 be spatially separated: the conductive tracks that route the contact areas to the contact pads cannot be allowed to cross a different contact area. This limits the measurement resolution of such a target.

This problem is avoided in the target panel 10 according to the invention since the bullet penetrates two discrete layers and therefore produces two signals, each indicative of which area it strikes in each layer. Thus in the above example, the apparent ambiguity of where the bullet penetrates the first layer 11 is resolved by the fact that it penetrates the second layer 12 in the annular contact area 21' surround the central area 20. This being the case, the bullet cannot have entered the first layer in the central area 20 even though it is the contact pad 20*c* connected to the central area 20 in the first layer 11 that senses the short circuit.

Likewise, we can consider a bullet that enters the first layer 11 of the target panel at arrow B and exits the second layer 12 at arrow B'. It is clear that this bullet also strikes in the region of the first annular area 21, but it penetrates the conductive track 20*a'* in the second layer 12 that routes the central target area 20' to the contact pad 20*c'*. In this case the apparent ambiguity in the second layer 12 is resolved by the first layer 11, which unambiguously indicates the bullet entered the first annual area 21.

Figure 4:
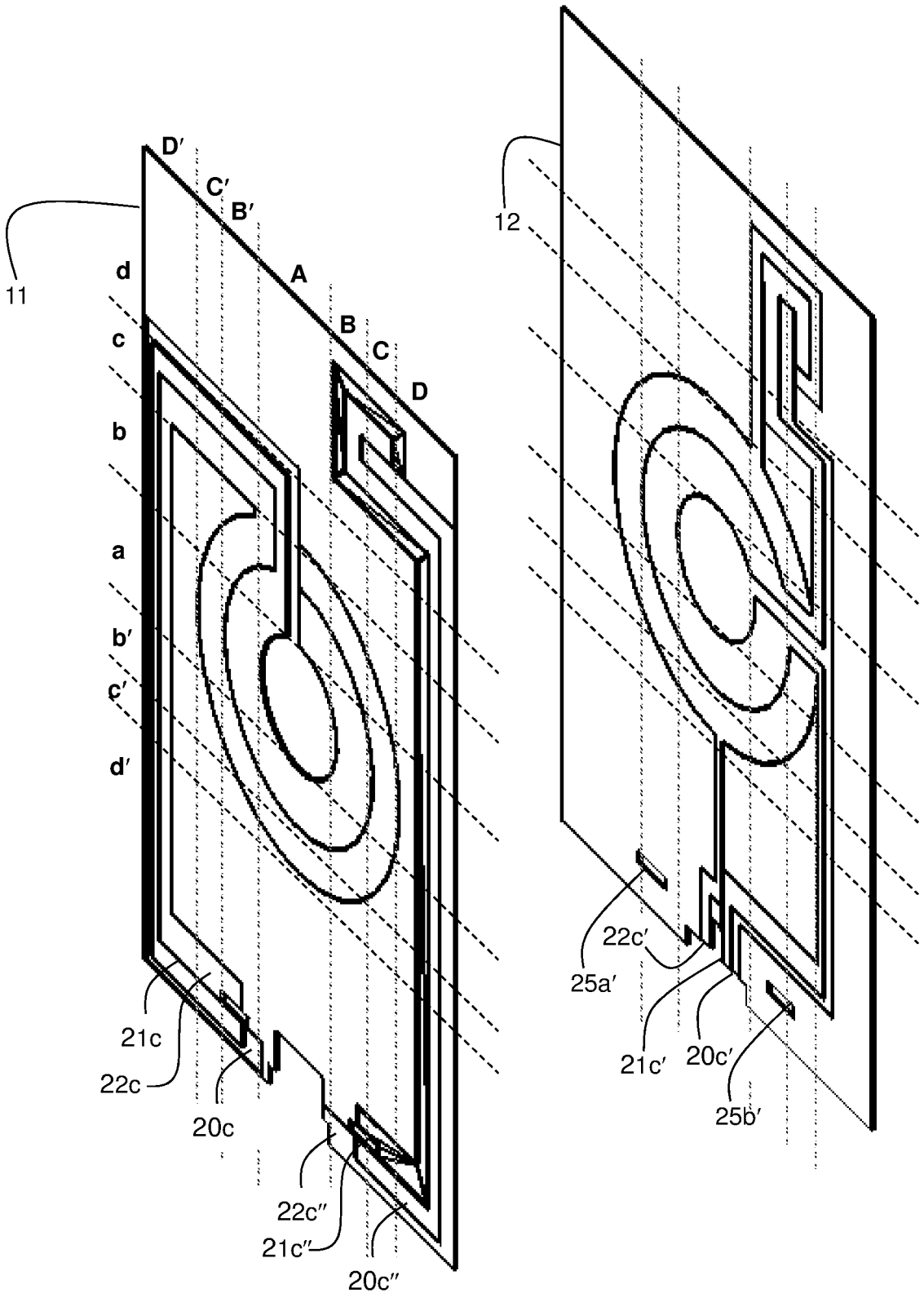
FIG. 4 is a perspective view of the two layers of the target panel relating to a truth table that maps pairs of indication signals to different areas of the target panel.

Extending this principle, FIG. 4 is a perspective view of the two layers 11 and 12 of the target panel wherein different areas of the target are identified using a matrix, allowing identification of where a bullet strikes the target according to which contacts of the two layers are shorted by the bullet. This is summarized in the following truth table.

TABLE 1

Truth Table

| Contact Pad ID | 20c' (Dark Grey) | 21c' (Blue) | 22c' (Black) |
|---|---|---|---|
| 20c (Brown) | Aa | Ab | Ac |
| 21c (Purple) | Ba | Ab', Ba, B'a | x |
| 22c (Orange) | Ca | x | Ac', ac', ac, B'b, Bb, C'b, Cb |
| 20c" (Grey) | Cd | | |
| 21c" (Brown) | Cd | | |
| 22c" (Green) | Cd | | |

It should be noted that the above Truth Table is only partial and representative. Better discrimination can be achieved by sub-dividing the target layers further, the only practical limitation being the need to route each thus designated target area to a separate contact pad. This in turn is limited only by the width of the target panel and the jaw in the hit scoring apparatus. It should also be noted that in order to sub-divide areas even further, it may be desirable or necessary to provide additional layers having conductive areas that are routed to corresponding contact pads. However, in the interest of brevity this is not shown in the figures since the principle of operation is unchanged.

So far we have described only the target panel 10, it being understood that it operates in conjunction with a custom hit scoring apparatus that will now be described. However, before doing so, we summarize the distinctive features of the target panel per se as comprising a pair of spaced part electrically conductive first and second layers separated by at least one electrically non-conductive layer. Each conductive layer has at least two discrete conductive areas routed by respective conductive tracks to separate contact pads on a common edge of the target panel. At least one of the conductive tracks in each layer intersects a conductive area in the same layer that is routed by a different conductive track to a different contact pad in the same layer. The conductive tracks in each of the conductive layers are arranged such that a portion of a conductive track that intersects a contact area in the first layer does not overlap a portion of a conductive track that intersects a contact area in the second layer. For example the conductive track identified as 20*a* in FIG. 2 and colored purple in FIG. 2*a*, crosses through the discrete areas identified as 21 and 22 in FIG. 2 and colored purple and orange, respectively in FIG. 2*a*. However, the conductive track 20*a* in the first layer 11 cannot overlap or intersect any other conductive track in either of the two layers and specifically not in the second layer 12. This ensures that a possible ambiguity as to which contact area is penetrated by a bullet that pierces a conductive track in one layer is resolved by the certainty as to which contact area is penetrated by the bullet in the other layer.

In saying this, some clarification is required regarding the definition of the contact areas. For example, Table 1 above may suggest that a bullet that shorts contact pads 21*c* and 21*c'* is identified by one of three different areas identified as Ab', Ba and B'a. However, this is merely a question of definition since all these areas are within the first annular area in each layer; so we can say with certainty that the bullet hit the target somewhere within the overlapping annular areas shown purple and blue in FIG. 2*a*. We also know with certainty that the bullet did not penetrate the conductive track 20*a'* in the second layer 12 (since this would have been detected by a different contact pad), thus effectively limiting the right quadrant of the annular overlap. The same of course is true of the outermost annular areas shown orange and black, respectively, in FIG. 2*a*. If further discrimination within these areas is required, this could be done by subdividing the areas into mutually separated areas each routed to a discrete contact pad. This might also require use of an auxiliary conductive layer as noted above.

Figure 5:
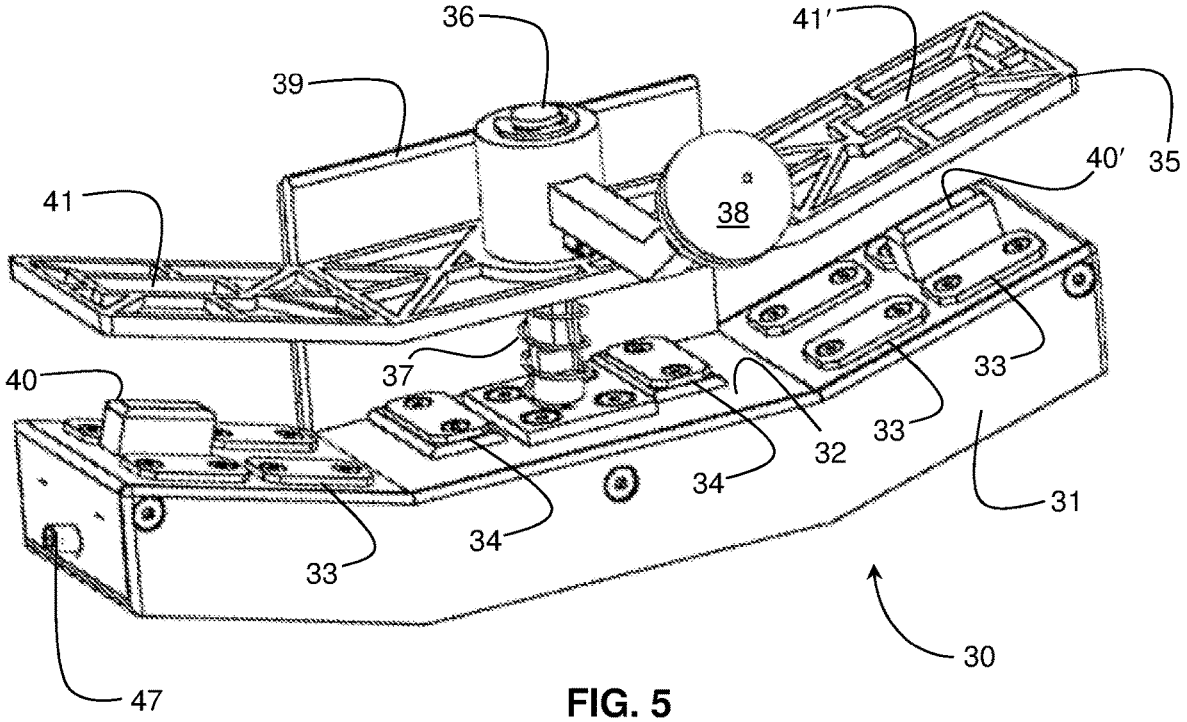
FIGS. 5 to 8 are pictorial representations of part of a hit-scoring apparatus for use with the target panel.
Figure 6:
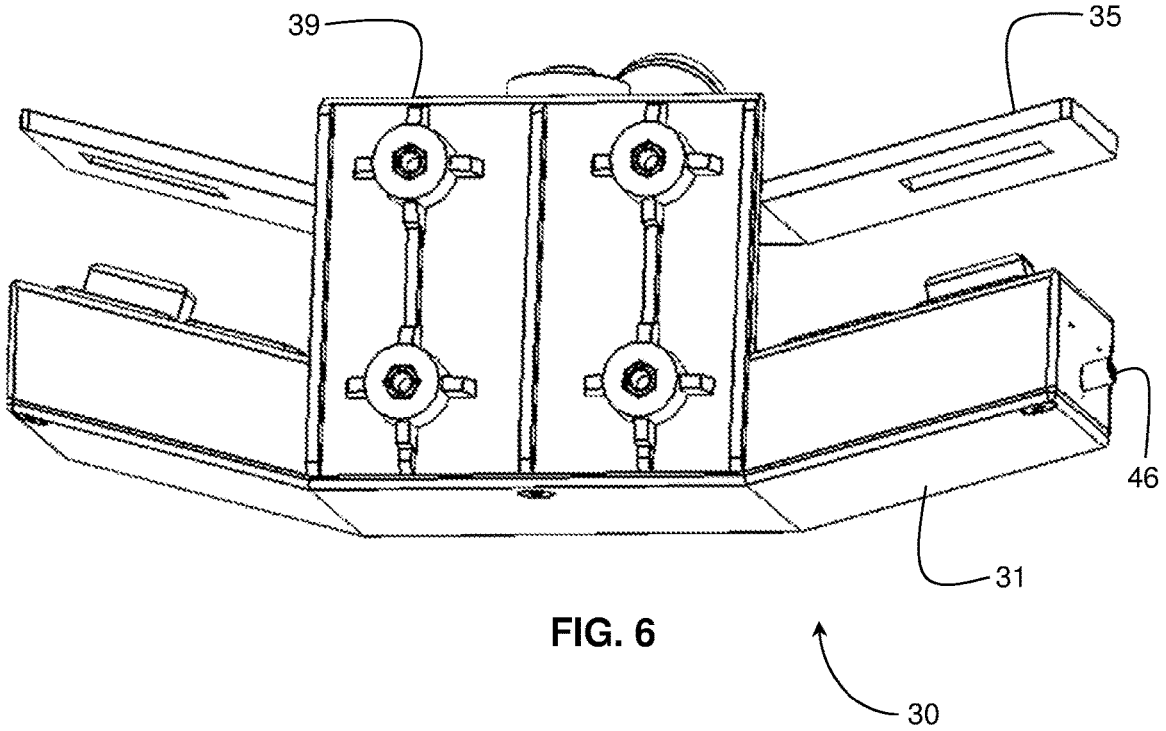
Figure 7:
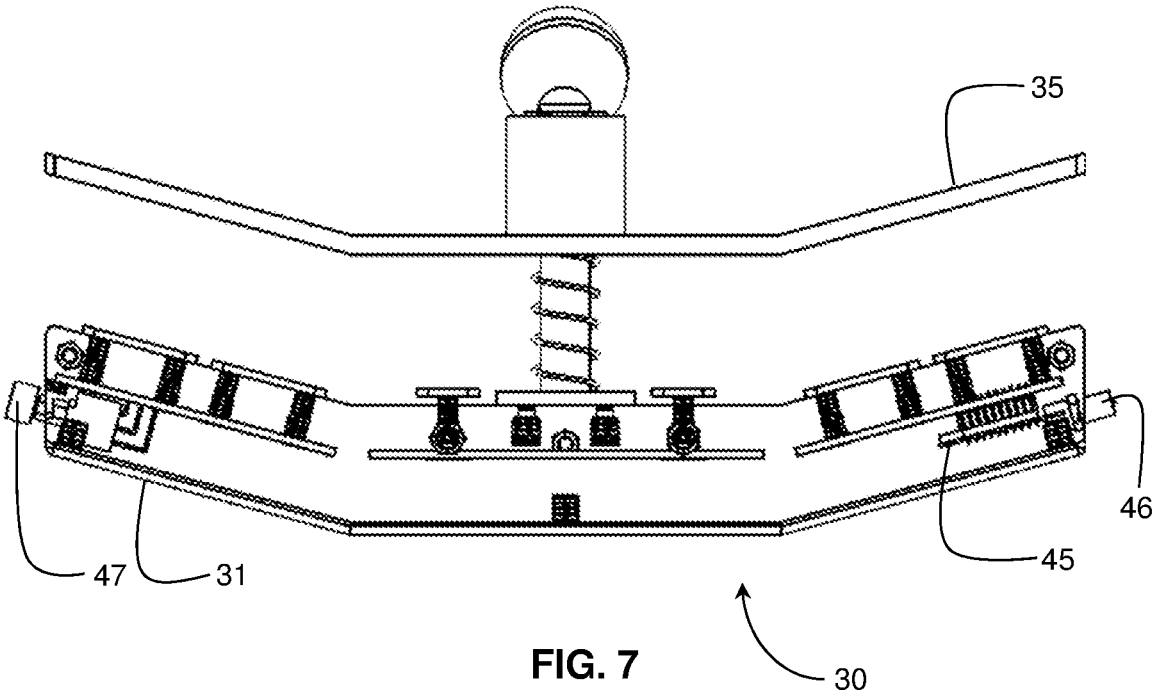
Figure 8:
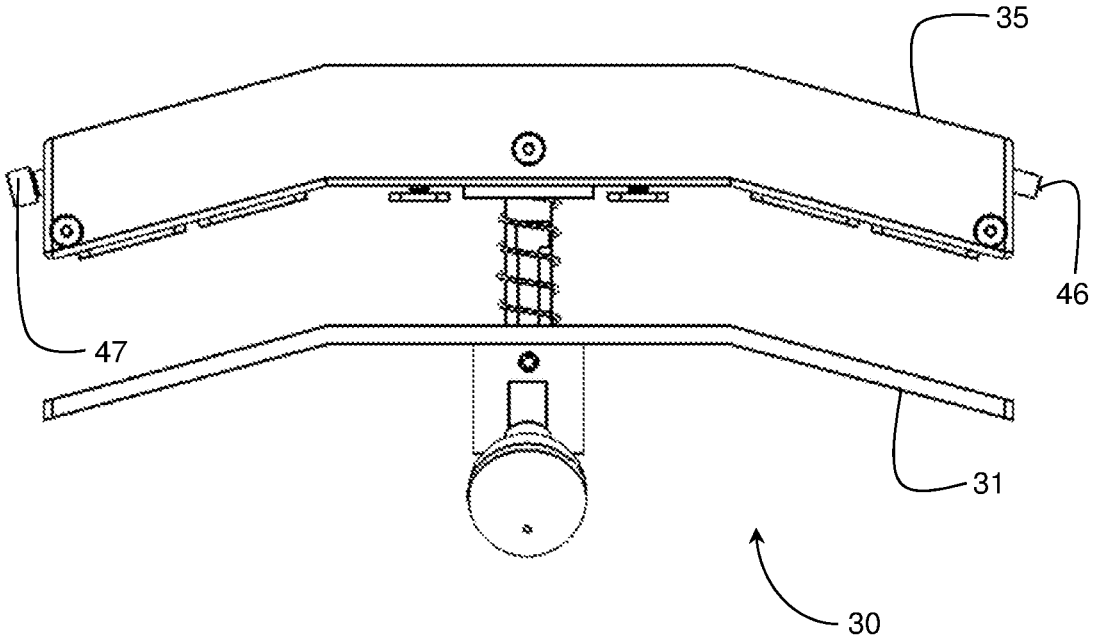

Reference is now made to FIGS. 5 to 8 showing perspective views of a clamping device 30 of a hit-scoring apparatus according to the invention comprising a fixed jaw 31 supporting on a rear surface 32 thereof a plurality of first contacts 33 and second contacts 34. The clamping device 30 further includes a movable jaw 35 that is mounted on a pin 36 projecting from the rear surface 32 of the fixed jaw 31 and is biased into an open position as shown in FIG. 5 by a coil spring 37. The movable jaw 35 is operated by a handle 38 in manner known per se. The fixed jaw 31 is attached to a mounting plate 39 by means of which the clamping device 30 may be supported on a suitable support surface. The mounting plate 39 also prevents rotation of the movable jaw 35 about the pin 36, thereby ensuring that the two jaws mate properly when closed. Proper registration between the two jaws is ensured by means of lugs 40, 40' projecting on opposite sides of the fixed jaw 31 which engage complementary apertures 41, 41' in the movable jaw 35. The pairs of lugs and apertures {40, 41} and {40', 41'} are spatially aligned with the respective apertures {25*a*, 25*a'*} and {25*b*, 25*b'*} of the target panel 30 so that when the target panel 30 is clamped between the two jaws 31 and 35, the contact pads in the target panel make good electrical contact with the respective contacts 33, 34 on the fixed jaw 31.

Each of the jaws 31 and 35 may consist of three sections: a central section and two lateral sections inclined with respect to the central section at an obtuse angle of about 160°. This requires that the target panel be foldable about vertical creases or that the act of closing the jaws of the clamping device 30 induce the required folding, which increases the rigidity of the target panel. This is important because if steps are not taken to support the rear second layer 12 of the target panel 10, a bullet that penetrates the front first layer 11 may simply push the rear second layer 12 away from the first layer 11, without actually penetrating it. Were this to occur, the bullet would not create the required short-circuit between the two layers by means of which penetration is detected. Nevertheless, it will be appreciated that the required support of the rear second layer 12 may be achieved by other means, such as by mounting a rigid layer behind the second layer 12 or clamping a rigid or semi-rigid panel behind the target panel 10.

The fixed jaw 31 has a generally hollow housing containing one or more circuit boards 45 (shown in FIG. 7) to which proximate contacts 33 or 34 are connected and which contain circuitry for sensing a short-circuit between one of the first contacts 33 and one of the second contacts 34 and producing indication signals indicating which of the first and second contacts were shorted. The circuit boards 45 may also contain a processor that is responsive to the indication signals for identifying which area of the target panel was hit. Additionally or alternatively, the circuit boards 45 may be connected to an outlet 46, allowing connection to a remote processor and/or indicator using either a wired or wireless protocol. They may also be connected to a jack socket 47 for connecting an external DC supply.

Significantly, no contacts are provided on the movable jaw 35, which may be formed of an electrically insulating material. This has the benefit that the only connections from the contacts 33 and 34 to the circuit boards 45 are within the fixed jaw 31 and are thus not subjected to movement or strain when opening and closing the clamping device 30.

Figure 9:
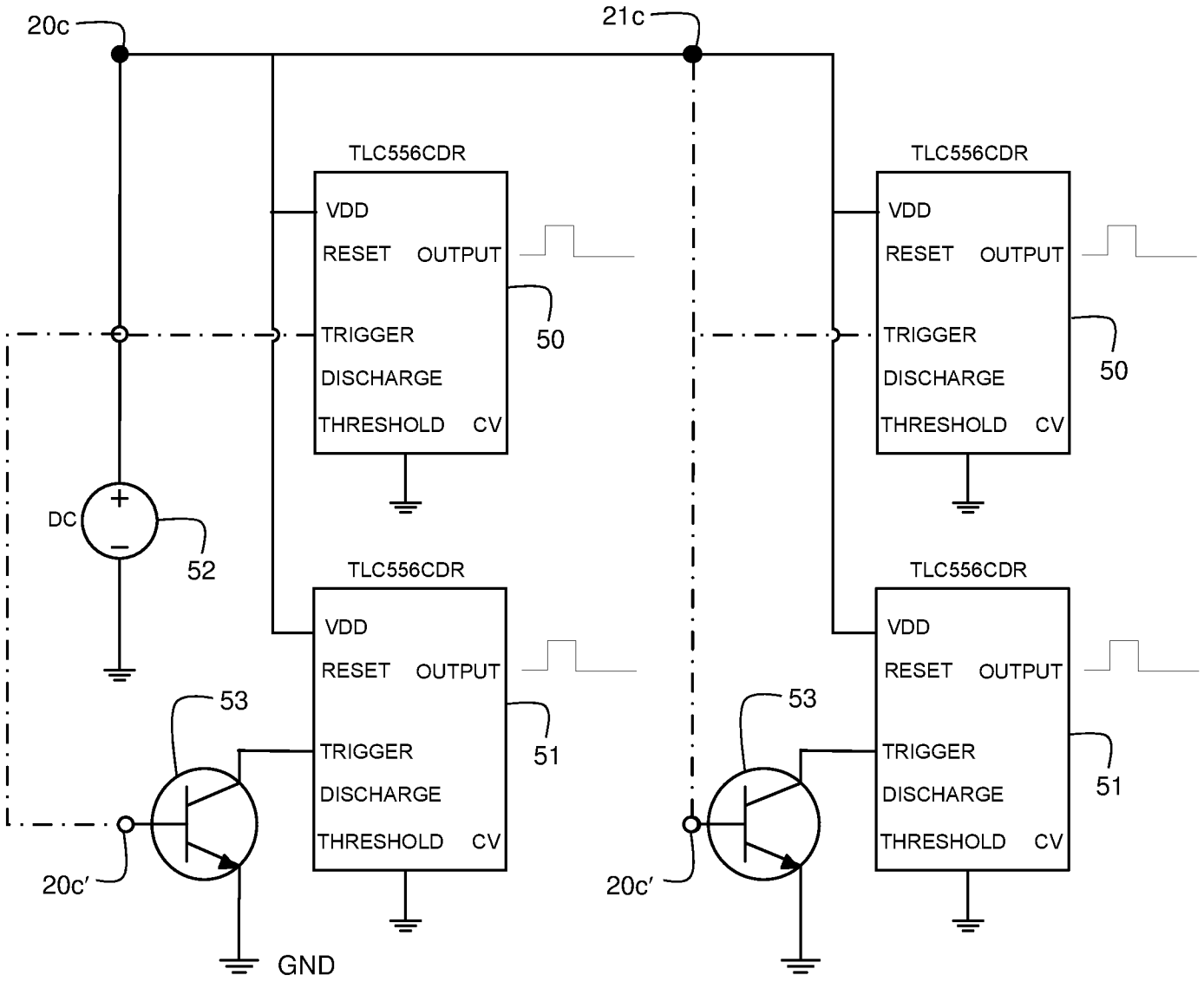
FIG. 9 shows schematically a detail of a circuit for counting hits and determining possible areas where the target panel is hit.

Reference is now made to FIG. 9 showing schematically a detail of a circuit for counting hits and determining possible areas where the target panel is hit. Before describing this circuit, it should be noted that providing multiple contact areas on both layers 11 and 12 complicates the detection as compared with the arrangement disclosed in U.S. Pat. No. 6,994,347 where the rear second layer constituted a unitary contact that could therefore serve as a ground plane. In such an arrangement, each contact pad co-operates with the ground plane to act as switch, whose closure indicates which contact area was penetrated by the bullet.

But this is not the case in the present invention, because we need to determine which contact area in each layer is hit by the bullet, and therefore the contacts in neither layer can serve as a unitary ground plane. To this end, the circuit comprises for each pair of contact pads in the two layers e.g. {20*c*, 20*c*'}, {20*c*, 21*c*'} and so on a discriminator comprising a first timer 50 having an input connected to the corresponding contact pad e.g. 20*c* in the first layer and a second timer 51 having an input connected to the corresponding contact pad e.g. 20*c*', 21*c*' in the second layer. The timers 50, 51 may be constituted by an IC circuit in the ubiquitous 555 or 556 families. The auxiliary components are not shown in FIG. 9 for ease of description and because use of these ICs is known per se. The circuit is powered by a DC power supply 52 that may be a battery inside the fixed jaw or may be derived from an external power supply coupled to the circuit via the DC jack socket 47. A normally open electronic switch 53 is connected between each contact pad 20*c*', 21*c*', 22*c*' of the second layer 12 and GND. In the figure the switch 53 is shown as a NPN bipolar junction transistor although other devices such as opto-couplers may equally well and even preferably employed. Thus, with reference to the figure, the base of the transistor is connected to the respective contact, the emitter is connected to GND and the collector is connected to the input (Trigger) of the second timer 51.

When a bullet 15 shorts between the two conductive layers 11, 12 of the target panel 10 as shown by the chain dotted lines for each channel, DC voltage is supplied simultaneously to the first timer 50 and to the base of the transistor 53, which is thus biased into conduction. Again, for ease of description, the biasing components are not shown in the figure. The first timer 50 produces a pulse constituting a first indication signal, which identifies the contact pad in the first layer shorted by the bullet. The second timer 51 produces a pulse of shorter duration constituting a second indication signal, which identifies the contact pad in the second layer shorted by the bullet. The outputs of all the timers 50, 51 are fed to a processor via a multiplexer neither of which is shown. The bullet passes through the target panel so fast that the duration of the short circuit is substantially instantaneous. The timers 50, 51 are therefore configured to produce pulses of much longer duration in order to allow the processor sufficient time to scan all of the timers and determine which pair of timers is active. This in turn allows the processor to access a read-only memory in which the Truth Table is stored and thereby determine which contact areas are shorted by the bullet. The processor may, of course, be a programmable device that is programmed to compute a cumulative count of hits and to show for each one where the target was hit. The processor, its associate memory and other circuitry may be mounted on the circuit board 45 shown in FIG. 7 or it may be coupled thereto via the outlet 46.

For the sake of completeness, it will also be appreciated that the results of the processor may be output in various ways. For example, they can be shown graphically on a display device coupled to the processor. Alternatively, a dummy target can be coupled to the processor and can have in discrete areas of the target different colored LEDs that are arranged to illuminate and provide a visual record. The cumulative hit count can be displayed on the display device or on a separate dedicated counter.

The invention claimed is:

1. A hit-scoring apparatus for shooting practice, comprising:

a target holder having a body constituting a fixed first jaw and a movable second jaw of a clamping device, said first jaw and said second jaw being electrically insulated from one another, a closure mechanism for imparting to said second jaw a substantially linear movement relative to the first jaw; and a target panel clampable between said first and second jaws, said target panel having a plurality of layers including an electrically conductive first layer and an electrically conductive second layer separated and spaced apart from said first layer by at least one electrically non-conductive layer, wherein when said target panel is clamped between the first and second jaws of said target holder, separate electrical contacts are established between predefined areas of said first and second layers and said first jaw, said electrical contacts being further connectable to a hit-scoring unit;

characterized in that:

a. the first jaw supports on a rear surface thereof a plurality of first and second electrical contacts, at least one of which first electrical contacts is adapted make contact with at least one respective area of the electrically conductive first layer and at least two of which second electrical contacts are adapted make contact with respective areas of the electrically conductive second layer through one or more respective apertures or gaps formed in the first layer;

b. each of the first electrical contacts is connectable to a source of first polarity DC voltage, each of the second electrical contacts is connectable to a source of opposite second polarity DC voltage via a respective normally open switch that is adapted to close in response to a bullet penetrating between the first layer and the second layer thereby applying said first polarity DC voltage to the respective switch coupled to the second electrical contact;

c. a respective first indicator is coupled to each of the first electrical contacts and is responsive to the switch closing for producing a first signal indicative of an area in the first layer hit by the bullet;

d. a respective second indicator is coupled to each switch and is responsive to the switch closing for producing a second signal indicative of an area in the second layer hit by the bullet; and e. said hit-scoring unit is adapted for coupling to each of the first indicators and to each of the second indicators and is responsive to the respective first and second signals for determining an area of the target that is commonly connected to the respective first and second contacts.

2. The apparatus according to claim 1, wherein the fixed jaw further comprises elongated lugs projecting from and fixedly attached to opposite sides of the jaw, said lugs registering with and engaging complementarily shaped, apertures in the lower part of said target panel.

3. The apparatus according to claim 2, wherein the movable jaw includes apertures registering with and accommodating the lugs in the fixed jaw.

4. The apparatus according to claim 1, wherein each of the jaws comprises a central section and two lateral sections inclined with respect to the central section at an obtuse angle and the target panel is provided with two longitudinally extending creases, imparting to the target panel a cross-sectional shape conforming to a gap between the fixed jaw and the movable jaw.

5. The apparatus of claim 1, wherein the closure mechanism includes a self-locking toggle clamp mechanism.

6. The apparatus according to claim 1, wherein the first indicator includes a timer for producing the first signal of sufficient duration to allow the hit-scoring unit to scan all of the first and second indicators in order to determine which are active.

7. The apparatus according to claim 1, wherein the second indicator includes a timer coupled to the respective contact pad in the second layer via said normally open switch, said time being configured to produce the second signal of sufficient duration to allow the hit-scoring unit to scan all of the second indicators in order to determine which is active.

8. The apparatus according to claim 7, wherein the normally open switch is an opto-coupler or a transistor.

9. The apparatus according to claim 1, further including a processor operatively coupled to each first indicator and to each second indicator and being configured to access a memory storing data that maps discrete contact areas to respective contact pads in the two layers.

* * * * *